US006003691A

United States Patent [19]

Owen

[11] Patent Number: 6,003,691

[45] Date of Patent: Dec. 21, 1999

[54] TOOL RACK

[76] Inventor: Jonathan R. Owen, 3221 S. 295th Pl., Auburn, Wash. 98001

[21] Appl. No.: 08/978,302

[22] Filed: Nov. 25, 1997

[51] Int. Cl.[6] ..... A47B 81/02

[52] U.S. Cl. ..... 211/65

[58] Field of Search ..... 211/65, 66, 70.6, 211/87.01; 206/361; 248/110

[56] References Cited

U.S. PATENT DOCUMENTS

| | | | |
|---|---|---|---|
| D. 150,507 | 8/1948 | McEntire | D4/3 |
| D. 300,406 | 3/1989 | Bordian | D8/367 |
| D. 312,960 | 12/1990 | Embree et al. | D8/367 |
| D. 315,091 | 3/1991 | Embree et al. | D8/367 |
| D. 327,213 | 6/1992 | Murphy | D8/367 |
| D. 372,189 | 7/1996 | Andis et al. | D8/373 |
| 3,504,878 | 4/1970 | Dressler | 248/205 |
| 4,275,862 | 6/1981 | Takagi et al. | 248/205 |
| 4,410,095 | 10/1983 | Dembicks | 211/60 |

*Primary Examiner*—Alvin Chin-Shue
*Assistant Examiner*—Sarah Purol
*Attorney, Agent, or Firm*—Joan H. Pauly

[57] ABSTRACT

A tool rack has a vertical mounting member securable to a vertical surface of a support structure, such as a wall. A horizontal support wall projects forwardly from a lower portion of the mounting member. The support wall is bifurcated and has a vertical opening extending therethrough configured to receive the handle of a tool to allow the head of the tool to be moved into a position in which it is supported by a top surface of the support wall. The rack has side walls extending downwardly from opposite side edge portions of the support wall. Each side wall is substantially coextensive with the support wall in a forward direction and has a rear vertical edge that is a continuation of a rear edge of the mounting member to provide a vertically continuous line of support above and below the support wall.

20 Claims, 2 Drawing Sheets

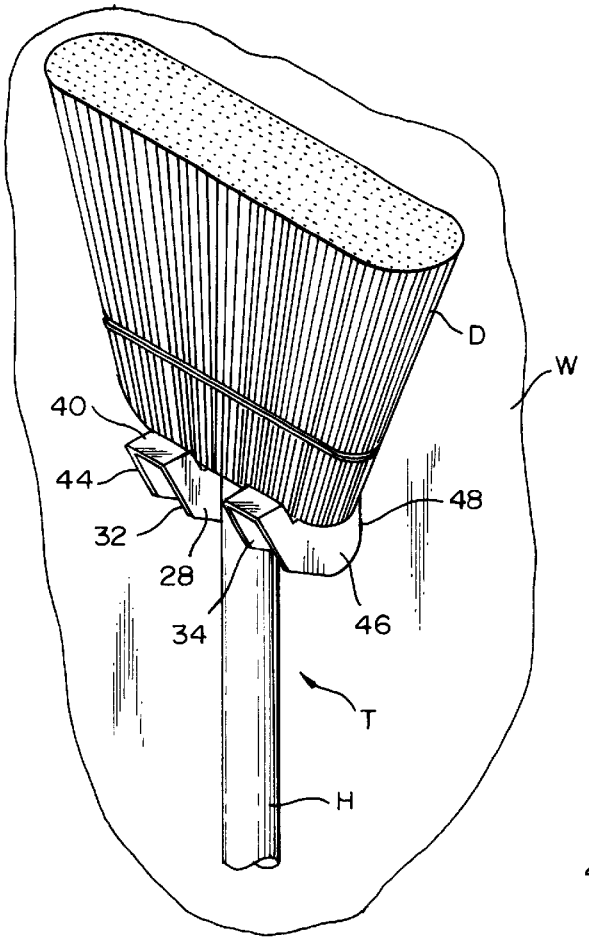
FIG. 1
FIG. 4A
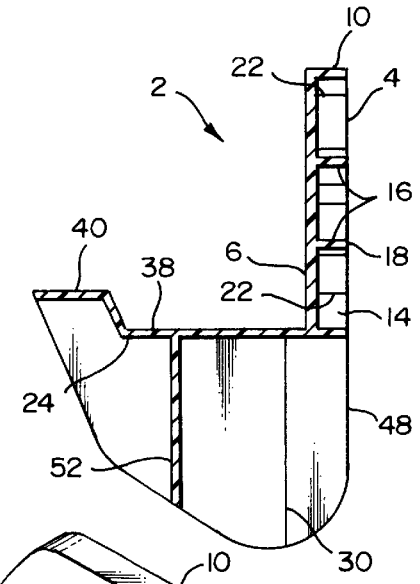
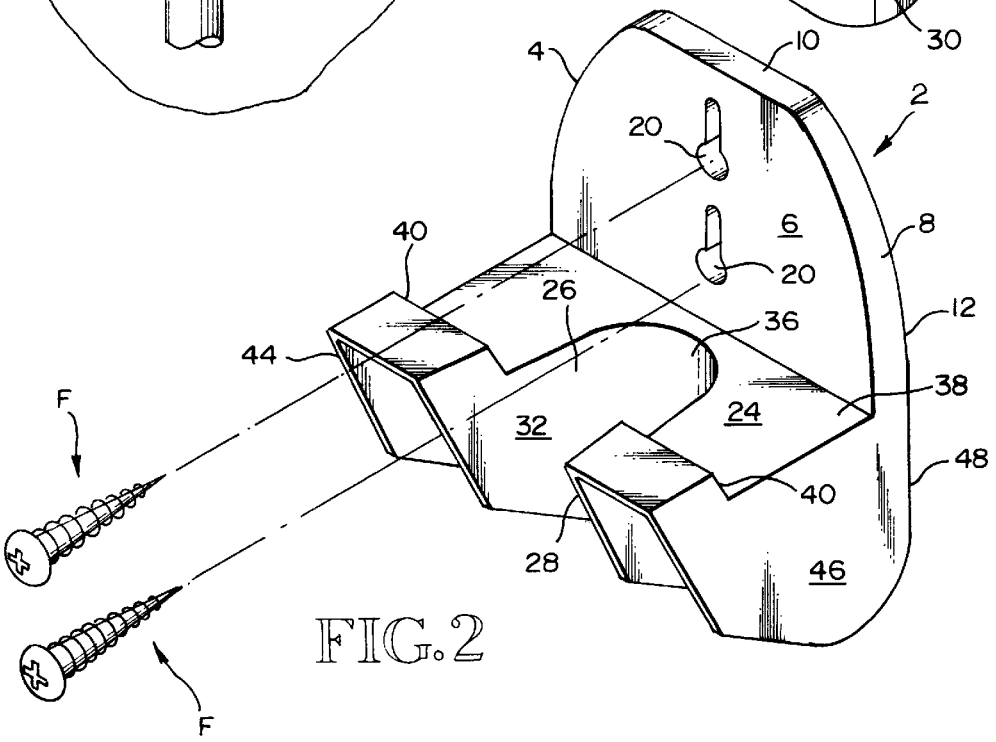
FIG. 2

TOOL RACK

TECHNICAL FIELD

This invention relates to racks for hanging tools of a type having an elongated handle and a head at one end of the handle. More particularly, it relates to such a rack that has a horizontal support surface for the head of the tool and a vertical opening for the downwardly depending handle, and that provides continuous lines of support extending above and below the support surface.

BACKGROUND INFORMATION

Various types of hooks, racks, and similar devices have been proposed for hanging long handled tools and other items. A known type of rack includes a bifurcated horizontal surface for supporting a head of a tool or other item. A major drawback of many known types of tool racks is that the racks lack sufficient strength to reliably support heavy tools. Another drawback is that the racks currently available tend to be unattractive.

SUMMARY OF THE INVENTION

The subject of the invention is a rack for hanging a tool of a type having an elongated handle and a head at one end of the handle. According to an aspect of the invention, the rack comprises a body including a vertical mounting member, a substantially horizontal support, and first and second side walls. The mounting member is securable to a vertical surface of a support structure and has laterally opposite rear vertical edges. The support projects forwardly from a lower portion of the mounting member. The support has a vertical opening extending therethrough configured to receive the handle of a tool to allow the head of the tool to be moved into a position in which it is supported by a top surface of the support. The side walls extend downwardly from opposite side edge portions of the support, respectively. Each side wall is substantially coextensive with the support in a forward direction and has a rear vertical edge that is a continuation of one of the rear edges of the mounting member. The rear edges of the mounting member and side walls provide opposite vertically continuous lines of support for the rack and a tool supported thereby when the mounting member is secured to a support surface.

The mounting member may be secured to a support surface, such as a wall, in various ways. Preferably, it is secured by means of a plurality of fasteners. In the preferred embodiment, the mounting member has a pair of vertically spaced, vertically aligned fastener holes extending therethrough for receiving fasteners to secure the mounting member to a support structure. The vertical, as opposed to horizontal, alignment of the holes provides greater stability. Horizontal alignment would allow each fastener to act as a fulcrum for back and forth rocking movement of the rack as downward forces are applied to it. The preferred vertical alignment greatly reduces or eliminates rocking movement.

The relative dimensions of the various portions of the rack body may also be varied. In the preferred embodiment, the rear vertical edges of the mounting member have a first vertical extent. The rear vertical edges of the side walls have a second vertical extent that is at least about fifty percent of the first vertical extent.

A feature of the invention is a vertical opening that is defined by an inner wall that extends downwardly from the support. The inner wall has opposite first and second side portions that are spaced laterally inwardly from the first and second side walls, respectively. The body of the rack further includes a support web extending laterally between and secured to each of the side portions and its corresponding side wall. This arrangement gives the rack added strength while allowing it to be relatively lightweight. Preferably, the inner wall has an arcuate rear portion interconnecting the side portions. Also preferably, the vertical opening has an open top, an open bottom, and an open forward end to permit a handle to be moved rearwardly into the opening.

In its preferred form, the mounting member comprises a front wall spaced rearwardly of the rear vertical edges of the mounting member. A plurality of strengthening ribs are positioned on a rear surface of the front wall. The ribs have rear surfaces substantially flush with the rear vertical edges of the mounting member. The inclusion of the ribs gives the rack added strength. The positioning of the rear surfaces of the ribs to be flush with the vertical rear edges positions the ribs to contact the support structure to provide added support for the rack during use. The arrangement of the front wall and ribs, while providing this added strength and support, also helps to minimize the weight of the rack.

The rack may be made from various materials. Preferably, the body of the rack is formed by integrally molded plastic. This manner of forming the body helps maximize the strength of the rack while minimizing its weight. It also facilitates the provision of various of the features discussed above.

When the vertical opening has an open forward end, the body of the rack preferably further comprises a pair of stop walls projecting upwardly from the support on opposite sides of the forward end. The stop walls help prevent a tool from inadvertently sliding forwardly off the rack.

The rack of the invention has a number of advantages. Its structure provides a high degree of strength but is also relatively simple and readily lends itself to cost effective manufacture. The applicant currently anticipates that racks constructed in accordance with the invention will be able to reliably support tools weighing in excess of one hundred pounds. In addition to being strong, the rack of the invention is highly durable and resistant to breakage. Still another advantage is that the rack has an attractive shape and can easily be manufactured with an attractive finish that further enhances its appearance.

These and other advantages and features will become apparent from the detailed description of the best mode for carrying out the invention that follows.

BRIEF DESCRIPTION OF THE DRAWINGS

In the drawings, like element designations refer to like parts throughout:

FIG. 1 is a pictorial view of the preferred embodiment of the invention shown mounted on a wall and supporting a broom.

FIG. 2 is a pictorial view of the tool rack shown in FIG. 1 looking toward the front and one side of the rack.

FIGS. 4A and 4B are sectional views taken substantially along the lines 4A—4A and 4B—4B in FIG. 3.

BEST MODE FOR CARRYING OUT THE INVENTION

Figure 4:
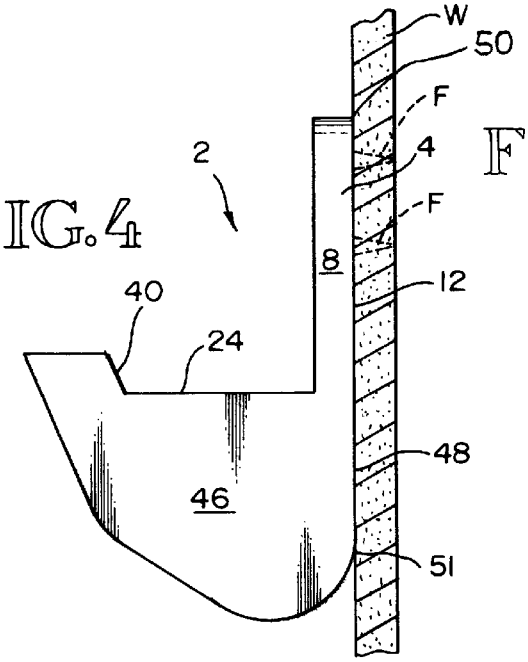
FIG. 4 is a side elevational view of the rack shown in FIGS. 1–3 mounted on a wall shown in section.
Figure 4B:
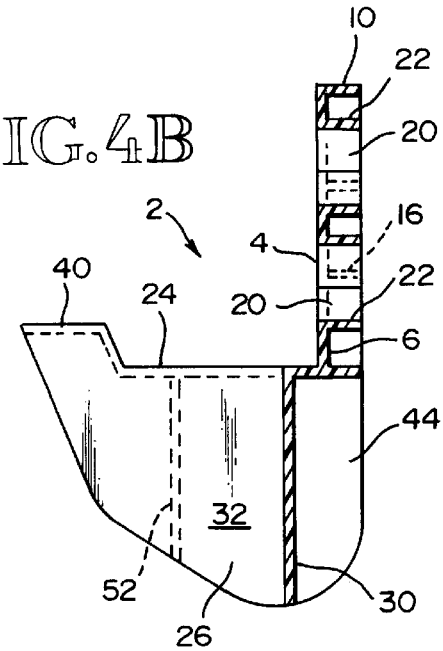

The drawings show a tool rack 2 that is constructed according to the invention and that also constitutes the best mode for carrying out the invention currently known to the applicant. The rack of the invention is intended to be used primarily for hanging a tool of a type having an elongated handle and a head at one end of the handle. The tool may also include additional elements, such as a second opposite head. In FIGS. 1 and 4, the rack 2 is shown mounted on a wall W. FIG. 1 shows the rack 2 supporting a broom T. The broom T is only one example of a tool that can be advantageously placed on the rack of the invention for convenient and space-efficient storage. Other examples include rakes and shovels.

The rack of the invention is designed to be mounted on a vertical surface of a support structure, such as a wall W. For this purpose, the rack 2 includes a vertical mounting member 4 that is securable to the vertical surface of the support structure. Referring to FIGS. 2–4B, in the preferred embodiment, the mounting member 4 includes a front wall 6 that extends vertically upwardly. The member 4 also includes laterally opposite side walls 8 and a top wall 10 that extend perpendicularly and rearwardly from the edges of the front wall 6. The side walls 8 terminate in laterally opposite rear vertical edges 12 that are spaced rearwardly of the front wall 6. A plurality of strengthening ribs 14, 16 are positioned on the rear surface of the front wall 6. The ribs include vertical ribs 14 and horizontal ribs 16 in a pattern best seen in FIG. 3. The rear surfaces 18 of the ribs 14, 16 are substantially flush with the rear vertical edges 12 formed by the side walls 8. In other words, the rear surfaces 18 are essentially in the same vertical plane as the rear vertical edges 12.

Figure 3:
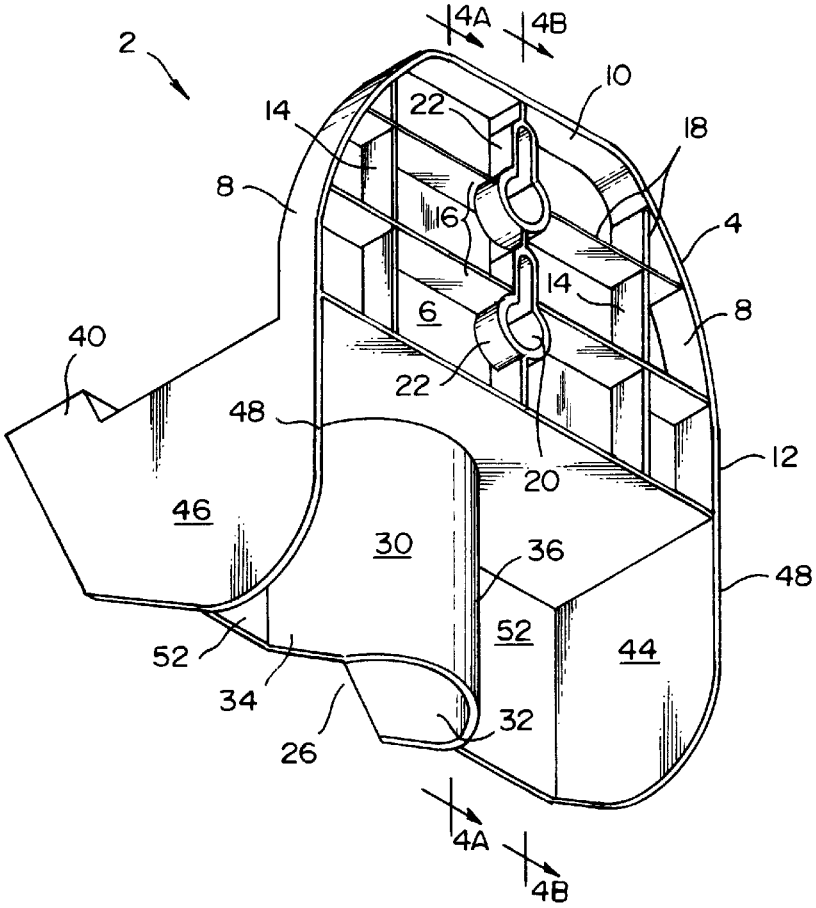
FIG. 3 is a pictorial view of the rack shown in FIGS. 1 and 2 looking toward the bottom and rear of the rack.

The mounting member 4 may be secured to a support surface in various ways. As shown in the drawings, in the preferred embodiment, the mounting member 4 is secured by a plurality of screw-type fasteners F. As shown, there are two fasteners F. The mounting member 4 is provided with a pair of vertically is spaced, vertically aligned fastener holes 20 extending therethrough for receiving the fasteners F to secure the mounting member 4 to a wall W or other support structure. Each hole 20 extends through the front wall 6 and has an upside down keyhole configuration. In order to strengthen the engagement of the fasteners F with the mounting member 4, the rearward extent of the holes 20 is extended for the full thickness of the mounting member 4 by means of fastener hole sidewalls 22. These sidewalls 22 are best seen in FIG. 3. The rear edges of the sidewalls 22 and the top wall 10 are flush with the laterally opposite rear vertical edges 12 and rib rear surfaces 18 of the mounting member 4 to cooperate with the edges 12 and surfaces 18 in engaging a vertical surface of a support structure to stabilize the mounting of the rack 2 on the structure.

The rack 2 also includes a substantially horizontal support 24 projecting forwardly from a lower portion of the mounting member 4. In the preferred embodiment, the support 24 is formed by a horizontal wall, best seen in FIGS. 3, 4A, and 4B. The support wall 24 has a vertical opening 26 extending therethrough. The opening 26 has an open top, an open bottom, and an open forward end 28. The opening extends through the support wall 24 and downwardly beyond the wall 24 to the bottom of the rack 2. Throughout its vertical extent, the opening 26 is defined by an inner wall 30. The inner wall 30 has first and second opposite and substantially parallel side portions 32, 34. It also has a arcuate rear portion 36 interconnecting the side portions 32, 34.

As can been seen in FIG. 2, the opening 26 gives the horizontal support 24 a bifurcated configuration with the two opposite legs of the bifurcation extending around opposite sides of the opening 26. The opening 26 is configured to receive the handle H of a tool T to allow the head D of the tool T to be moved into a position in which it is supported by the top surface 38 of the support 24. The open forward end 28 of the opening 26 permits the handle H to be moved rearwardly into the opening 26 while holding the head D just slightly above the height of the support 24. Preferably, the rack 2 further includes a pair of stop walls 40 projecting upwardly from the support wall 24 on opposite sides of the forward end 28, as shown in FIGS. 1 and 2. The stop walls 40 prevent the head D of the tool T from inadvertently sliding forwardly off the support 24. This function of the stop walls 40 is illustrated in FIG. 1.

In addition to the mounting member 4 and support 24, the body of the rack 2 also includes first and second side walls 44, 46. These side walls 44, 46 extend downwardly from opposite side edge portions of the support wall 24, respectively, as best seen in FIG. 3. Each side wall 44, 46 is substantially coextensive with the support 24 in a forward direction. In other words, the side wall extends along the outer edge of the support 24 along at least substantially the entire forward to rearward extent of the support 24. As can be seen in FIGS. 2–4, the rear portion of each wall 44, 46 is a downward continuation of the respective side wall 8 of the mounting member 4.

An important feature of the invention is the structuring of the rack 2 to provide laterally opposite vertically continuous lines of support extending both upwardly and downwardly from the horizontal support 24 to provide a secure and stable engagement between the rack 2 and the vertical surface of a support structure W. These lines of support are provided by the rear vertical edges 12 of the mounting member side walls 8 and the rear vertical edges 48 of the lower side walls 44, 46. The rear vertical edge 48 of each of the lower side walls 44, 46 is a downward continuation of one of the rear edges 12 of the mounting member 4. FIG. 4 illustrates one of the continuous lines of support extending between points 50 and 51. Between these two points, there is an essentially continuous line of engagement between the rack edges 12, 48 and the surface of the wall W to which the mounting member 4 is secured by fasteners F. The vertical extents of the edges 12, 48 may be varied in accordance with the invention. Preferably, the vertical extent of the lower side wall edges 48 is at least about fifty percent of the vertical extent of the rear vertical edges 12 of the mounting member 4. In the illustrated preferred embodiment, it is about sixty-three percent.

Each of the lower side walls 44, 46 is spaced laterally outwardly from the respective side portion 32, 34 of the inner wall 30 that forms the vertical opening 26. A support web 52, shown in FIGS. 3, 4A, and 4B, extends laterally between and is secured to each side portion 32, 34 of the inner wall 30 and its corresponding lower side wall 44, 46. The result is a hollow but strong configuration for the lower portion of the rack 2. The hollowness of the configuration helps maintain low cost of manufacture of the rack 2 since it results in significant savings in materials. It also helps minimize the weight of the rack 2 to facilitate handling of the rack 2 by the user and avoid adding unnecessary weight to be borne by the support structure.

The rack 2 may be made from various materials and may be manufactured using a variety of methods. However, the rack 2 is preferably made of molded plastic. In the currently preferred embodiment, the entire rack 2 is made in a single integrally molded piece in a one-step molding procedure. This provides a highly efficient manufacturing procedure and results in a very strong and lightweight rack.

In addition to its qualities of durability and strength, the rack 2 is also easy to use. In order to mount the rack 2 on a support structure, such as the wall W shown in FIG. 4, all that is required is to place the rack 2 in the desired position on the vertical surface of the wall W, mark the fastener locations, and set the rack 2 aside. The fasteners F are then screwed into or otherwise secured to the wall W at the fastener locations. Then, the rack 2 is moved against the wall W with the fastener heads being received in the enlarged lower portions of the fastener holes 20, and the rack 2 is permitted to slide downwardly to allow the shafts of the fasteners F to slide upwardly in the upper reduced width portions of the fastener holes 20. The rack 2 will continue sliding downwardly until the shaft of each fastener F engages the upper end of its respective fastener hole 20.

Once the rack 2 has been mounted on the wall W, it is available for supporting a tool. To position the tool T on the rack 2, all that is required is to hold the tool T in a vertical position with its head D at the top slightly above the horizontal support 24. Then the handle H is slid rearwardly into the vertical opening 26 until the head D clears the stop walls 40. Then, the tool T is simply lowered until the bottom of the head D is supported by the horizontal support surface 24. The user then simply releases the tool T and allows it to remain in place on the rack 2 until removal from the rack 2 is desired. The removal procedure is simply the reverse of the hanging procedure.

Although the preferred embodiment of the invention has been illustrated and described herein, it is intended to understood by those skilled in the art that various modifications and omissions in form and detail may be made without departing from the spirit and scope of the invention as defined by the following claims.

What is claimed is:

1. A rack for hanging a tool of a type having an elongated handle and a head at one end of the handle, said rack comprising a body including:

a vertical mounting member securable to a vertical surface of a support structure and having laterally opposite rear vertical edges;

a substantially horizontal support projecting forwardly from a lower portion of said mounting member, said support having a vertical opening extending therethrough configured to receive the handle of a tool to allow the head of the tool to be moved into a position in which it is supported by a top surface of said support; and first and second side walls extending downwardly from opposite side edge portions of said support, respectively, each said side wall being substantially coextensive with said support in a forward direction and having a rear vertical edge that is a continuation of one of said rear edges of said mounting member;

said rear vertical edge of each said side wall forming, with a corresponding one of said rear edges of said mounting member, a vertically continuous line of support for the rack and a tool supported thereby when said mounting member is secured to a vertical surface of a support structure, said line of support providing an essentially continuous line of engagement between said vertical surface and said rear vertical edge of the side wall and the corresponding rear edge of said mounting member.

2. The rack of claim 1, wherein said mounting member has a pair of vertically spaced, vertically aligned fastener holes extending therethrough for receiving fasteners to secure the mounting member to a support structure.

3. The rack of claim 1, wherein said rear vertical edges of said mounting member have a first vertical extent, and said rear vertical edges of said side walls have a second vertical extent that is at least about fifty percent of said first vertical extent.

4. The rack of claim 3, wherein said vertical opening is defined by an inner wall that extends downwardly from said support and has opposite first and second side portions that are spaced laterally inwardly from said first and second side walls, respectively; and said body further includes a support web extending laterally between and secured to each of said side portions and its corresponding side wall.

5. The rack of claim 4, wherein said inner wall has an arcuate rear portion interconnecting said side portions.

6. The rack of claim 5, wherein said vertical opening has an open top, an open bottom, and an open forward end to permit a handle to be moved rearwardly into said opening.

7. The rack of claim 4, wherein said vertical opening has an open top, an open bottom, and an open forward end to permit a handle to be moved rearwardly into said opening.

8. The rack of claim 1, wherein said vertical opening is defined by an inner wall that extends downwardly from said support and has opposite first and second side portions that are spaced laterally inwardly from said first and second side walls, respectively; and said body further includes a support web extending laterally between and secured to each of said side portions and its corresponding side wall.

9. The rack of claim 8, wherein said inner wall has an arcuate rear portion interconnecting said side portions.

10. The rack of claim 9, wherein said vertical opening has an open top, an open bottom, and an open forward end to permit a handle to be moved rearwardly into said opening.

11. The rack of claim 8, wherein said vertical opening has an open top, an open bottom, and an open forward end to permit a handle to be moved rearwardly into said opening.

12. A rack for hanging a tool of a type having an elongated handle and a head at one end of the handle, said rack comprising a body including:

a vertical mounting member securable to a vertical surface of a support structure and having laterally opposite rear vertical edges;

a substantially horizontal support projecting forwardly from a lower portion of said mounting member, said support having a vertical opening extending therethrough configured to receive the handle of a tool to allow the head of the tool to be moved into a position in which it is supported by a top surface of said support; and first and second side walls extending downwardly from opposite side edge portions of said support, respectively, each said side wall being substantially coextensive with said support in a forward direction and having a rear vertical edge that is a continuation of one of said rear edges of said mounting member;

said rear edges of said mounting member and said side walls providing opposite vertically continuous lines of support for the rack and a tool supported thereby when said mounting member is secured to a support structure;

wherein said mounting member comprises a front wall spaced forwardly of said rear vertical edges of said mounting member, and a plurality of strengthening ribs on a rear surface of said front wall, said ribs having rear surfaces substantially flush with said rear vertical edges of said mounting member.

13. The rack of claim 12, wherein said body is formed by integrally molded plastic.

14. The rack of claim 12, wherein said rear vertical edges of said mounting member have a first vertical extent, and said rear vertical edges of said side walls have a second vertical extent that is at least about fifty percent of said first vertical extent.

15. The rack of claim 14, wherein said vertical opening is defined by an inner wall that extends downwardly from said support and has opposite first and second side portions that are spaced laterally inwardly from said first and second side walls, respectively; and said body further includes a support web extending laterally between and secured to each of said side portions and its corresponding side wall.

16. The rack of claim 12, wherein said vertical opening is defined by an inner wall that extends downwardly from said support and has opposite first and second side portions that are spaced laterally inwardly from said first and second side walls, respectively; and said body further includes a support web extending laterally between and secured to each of said side portions and its corresponding side wall.

17. The rack of claim 16, wherein said body is formed by integrally molded plastic.

18. The rack of claim 8, wherein said body is formed by integrally molded plastic.

19. The rack of claim 1, wherein said body is formed by integrally molded plastic.

20. The rack of claim 1, wherein said vertical opening has an open forward end, and said body further comprises a pair of stop walls projecting upwardly from said support on opposite sides of said forward end.

* * * * *